US012110647B2

(12) United States Patent
Inagaki et al.

(10) Patent No.: US 12,110,647 B2
(45) Date of Patent: Oct. 8, 2024

(54) BAG BODY AND METHOD FOR PRODUCING BAG BODY

(71) Applicants: KAJIMA CORPORATION, Tokyo (JP); FUDO TETRA CORPORATION, Tokyo (JP); KYOWA CO., LTD., Osaka (JP)

(72) Inventors: Satoshi Inagaki, Tokyo (JP); Hidehiro Fujita, Tokyo (JP); Issei Umetsu, Tokyo (JP); Hirofumi Koyama, Tokyo (JP); Masataka Kinoshita, Tokyo (JP); Koji Kajiwara, Osaka (JP); Hironori Kawamura, Osaka (JP)

(73) Assignee: KYOWA CO., LTD., Osaka (JP)

( * ) Notice: Subject to any disclaimer, the term of this patent is extended or adjusted under 35 U.S.C. 154(b) by 0 days.

(21) Appl. No.: 18/559,277

(22) PCT Filed: May 7, 2021

(86) PCT No.: PCT/JP2021/017483

§ 371 (c)(1),
(2) Date: Nov. 6, 2023

(87) PCT Pub. No.: WO2022/234645

PCT Pub. Date: Nov. 10, 2022

(65) Prior Publication Data

US 2024/0229397 A1 Jul. 11, 2024

(51) Int. Cl.
*E02B 3/12* (2006.01)
*B65D 88/22* (2006.01)

(52) U.S. Cl.
CPC ..... *E02B 3/127* (2013.01); *B65D 88/22* (2013.01); *B65D 2588/16* (2013.01)

(58) Field of Classification Search
CPC ..... E02B 3/127; B65D 88/22; B65D 2588/16
(Continued)

(56) References Cited

U.S. PATENT DOCUMENTS 4,441,627 A * 4/1984 Takeuchi ..... B65D 90/048 383/105
5,584,599 A * 12/1996 Knittel ..... E02B 3/127 52/561

(Continued)

FOREIGN PATENT DOCUMENTS

JP 2003129444 A 5/2003
JP 2008063837 A 3/2008
JP 2018188805 A 11/2018

OTHER PUBLICATIONS

Office Action issued Feb. 8, 2022 in OEE Japanese Application 2021-562856 prior to grant, including English Translation.

*Primary Examiner* — Peter N Helvey
(74) *Attorney, Agent, or Firm* — NovoTechIP International PLLC

(57) ABSTRACT

A bag body 10 is filled with stones 12. A restraining rope 14 extends from the bottom of the bag body 10 through the center of the bag body 10 and is pulled up together with a lifting rope 15 to lift the bag body 10. The bag body 10 is within a predetermined range centered about a curve given by W/H1 (diameter/restraining rope length)=15.898×(W/W0)$^2$−17.784×(W/W0)+6.6314, where W represents the diameter of the bag body 10, H1 represents the length of the restraining rope 14 from the bottom portion of the bag body 10 to a root position of a mouth closing rope 13 of a bag material through the center of the bag body 10, and W0 represents the diameter when the bag material 11 is filled with the filling material 12.

7 Claims, 5 Drawing Sheets

(58) Field of Classification Search
USPC ..... 383/7
See application file for complete search history.

(56) References Cited

U.S. PATENT DOCUMENTS

| | | | | | |
|---|---|---|---|---|---|
| 5,669,732 | A * | 9/1997 | Truitt | E02B 3/108 | 405/20 |
| D393,322 | S * | 4/1998 | Suttles | D25/164 | |
| 5,865,564 | A * | 2/1999 | Miller | E02B 3/108 | 405/91 |
| 6,126,362 | A * | 10/2000 | Carter | E02B 3/108 | 405/91 |
| 6,186,701 | B1 * | 2/2001 | Kempers | E02B 3/127 | 383/105 |
| 6,364,571 | B1 * | 4/2002 | Doolaege | E01D 15/20 | 405/91 |
| 11,718,449 | B2 * | 8/2023 | Payant | B65D 33/08 | 383/7 |
| 2006/0072969 | A1 * | 4/2006 | Obermeyer | E05F 15/53 | 405/91 |
| 2007/0003369 | A1 * | 1/2007 | Hanson | E02B 3/04 | 405/15 |
| 2009/0208288 | A1 * | 8/2009 | Stephens | E02B 3/127 | 405/302.6 |
| 2012/0117739 | A1 * | 5/2012 | Cook | E02B 3/127 | 405/17 |

* cited by examiner

BAG BODY AND METHOD FOR PRODUCING BAG BODY

TECHNICAL FIELD

The present invention relates to bag bodies and methods for manufacturing bag bodies, and particularly to a bag body suitable for stability against waves and a method for manufacturing such a bag body.

BACKGROUND ART

A conventional bag is disclosed in, for example, Japanese Unexamined Patent Application Publication No. 2003-129444 (Patent Literature 1). According to this publication, in order to provide a bag material for civil engineering work that prevents a filling material from moving and is not shear-deformed even when repeatedly subjected to water currents and waves and a bag body using the bag material, a bag material made of a knitted mesh of synthetic fibers and filled with a filling material is provided with a restraining tool connecting bottom and mouth portions of the bag material. The restraining tool is connected to the bag material and is pulled out of the bag material through its closed mouth portion.

CITATION LIST

Patent Literatures

Patent Literature 1: Japanese Unexamined Patent Application Publication No. 2003-129444

SUMMARY OF INVENTION

Technical Problem

For conventional bag-type foot protection bag materials, the stability factor that is necessary to calculate the required mass of the bag body against waves (wave height) is obtained from the existing experiments. However, there are various forms of bag bodies and their stabilities are not the same. Therefore, even if the bag bodies are installed after specifying waves at the installation location, the bag materials may slide or roll and are washed away by the waves.

The present invention was made to solve the above problem, and it is an object of the present invention to provide optimal values of the height and diameter of a bag body by adjusting the length of a restraining rope as a restraining tool in the bag body against waves, and to provide a method for manufacturing such a bag body.

Solution to Problem

A bag body according to the present invention includes a bag material including a bottom portion and an opening portion. A lifting rope is provided around the opening portion, and a restraining rope that is pulled out through the opening portion is provided at the bottom portion. The bag material is filled with a filling material to form the bag body. The opening portion is closed after the bag material is filled with the filling material. The bag body is characterized by being within a predetermined range centered about a curve given by W/H1 (diameter/restraining rope length)=15.898×(W/W0)^2−17.784×(W/W0)+6.6314, where W represents a diameter of the bag body, H1 represents a length of the restraining rope from a bottom portion of the bag body to a root position of a mouth closing rope of the bag material through a center of the bag body, and W0 represents a diameter of the bag body when the bag body formed by filling the bag material with the filling material is most stable against waves.

Preferably, the predetermined range is a range of 83% to 119%.

The restraining rope may be a rope or belt made of synthetic fibers.

According to an embodiment of the present invention, the restraining rope includes mesh at the bottom portion of the bag material bundled and pulled up toward a mouth portion.

According to another embodiment of the present invention, a mouth closing rope is provided around the opening portion below the lifting rope, the opening portion is closed by the mouth closing rope, and the restraining rope is combined with the lifting rope and the mouth closing rope.

It is preferable that the restraining rope be a combination of a collection of mesh at the bottom portion of the bag material bundled and pulled up toward the mouth portion and a rope connected to the collection, and an optimal fixing position of the restraining rope be marked on the combination.

In another aspect of the present invention, a method for manufacturing a bag body includes the steps of: preparing a production frame for the bag body; and preparing a lifting rope around an opening, a mouth closing rope provided under the lifting rope, and a bag material including a restraining rope having its one end fixed to a bottom portion of the bag material. An optimal fixing position of the restraining rope in the bag is marked on the restraining rope. The method further includes the steps of: placing the bag material into the production frame in such a manner that the lifting rope around the opening of the bag material is caught by an opening end of the production frame, and pulling the other end of the restraining rope out of the bag material so as to pass through a center of the bag material, and in this state, placing a filling material into the bag material until the filling material reaches the optimal fixing position of the restraining rope for the bag material; and after placing the filling material, closing the opening of the bag material with the mouth closing rope, and removing the bag body from the production frame using the restraining rope and the lifting rope.

Advantageous Effects of Invention

The inventors examined stability of bag bodies based on various experiments, and as a result, found that the bag bodies that fall in a range centered about the curve given by a predetermined expression of W/H1 (diameter/restraining rope length) provides the highest stability against waves.

As a result, it is possible to provide the bag body shape that is effective against waves and a method for manufacturing such a bag body.

DESCRIPTION OF EMBODIMENTS

The inventors came to a certain conclusion after conducting experiments for checking the stability of bag bodies under various wave conditions (wave heights and periods) using bag body models with various sizes. The bag body models are models of a bag body filled with a filling material and scaled down to a certain size. The conclusion will be described below.

First, the bag body used in the experiments will be described. The bag body used in the experiments is a model with a set weight of 8 t and is about 1/35 the size of a real bag body.

Figure 1:
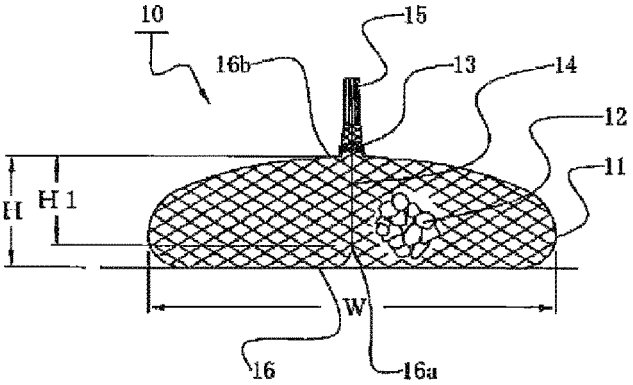
FIG. 1 is a diagram showing a bag body of a normal type.

FIG. 1 is a diagram showing the shape of the bag body. Referring to FIG. 1, a bag body 10 includes a bag material 11 made of a knitted mesh of synthetic fibers, and a filling material 12 filling the bag material 11 and having a density of 2 t/m$^3$ or more such as crushed stones, boulders, concrete lumps, iron ore lumps, barite lumps, steel slag lumps, or steel slag hydrated matrix lumps. The bag material 11 has an opening portion in its upper part. A lifting rope 15 is provided around the opening portion, and a mouth closing rope 13 goes through the mesh under the lifting rope 15.

After the bag material 11 is filled with the filling material, the opening portion is firmly tied with the mouth closing rope 13, and the mouth closing rope 13 together with the lifting rope 15 is pulled out of a production frame that will be described later. A restraining rope 14 as a restraining means is attached to the bottom portion of the bag material 11. This restraining rope 14 passes through the center of a bottom 16 of the bag body 10, and is pulled up together with the mouth closing rope 13 and the lifting rope 15 to lift the bag body 10.

As used herein, W represents the diameter when the bag material 11 is filled with the stones 12, and H1 represents the length of the restraining rope 14 from the bottom portion 16*a* of the bottom 16 of the bag body 10 to which the restraining rope 14 is attached to a root position 16*b* of the mouth closing rope 13 of the bag material 11 through the center of the bag body 10. H represents the length from the bottom 16 of the bag body 10 to the root position 16*b* of the mouth closing rope 13.

Figure 2:
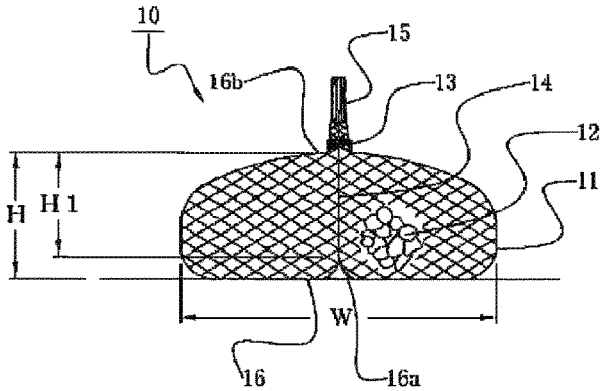
FIG. 2 is a diagram showing a bag body of a tall type that is longer in the vertical direction than the bag body of the normal type.
Figure 3:
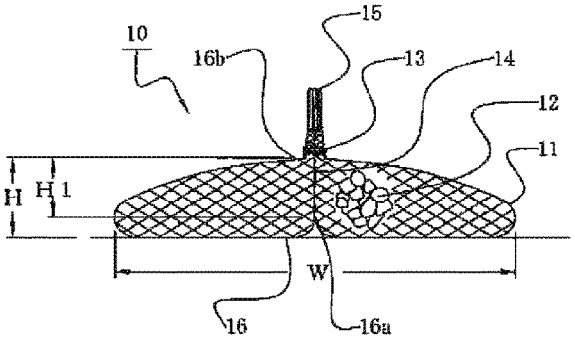
FIG. 3 is a diagram showing a bag body of a wide type that is longer in the width direction than the bag body of the normal type.

As shown in FIGS. 1 to 3, when the restraining rope 14 is pulled up together with the lifting rope 15, the lower part of the restraining rope 14 is lifted above the bottom 16 as shown by the bottom portion 16*a*. Therefore, as shown in the figures, H1 is the dimension of the restraining rope 14 from the position of the lifted bottom portion 16*a* to the position of an upper end 16*b* of the bag body 10. The position of the upper end 16*b* of the bag body 10 is the root position of the mouth closing rope 13, and the lifted position of the restraining rope 14 is usually about 40 to 120% of the total height H of the bag body 10 containing the filling material.

The bag body 10 has the shape described above (this is referred to as normal type). There may also be the following types of the bag body 10: the bag body 10 with a shape that is taller in the height direction (this is referred to as tall type), and the bag body 10 with a shape that is wider in the width direction (this is referred to as wide type). These shapes are shown in FIGS. 2 and 3. FIG. 2 shows the bag body 10 with a shape that is taller in the height direction, and FIG. 3 shows the bag body 10 with a shape that is wider in the width direction.

The bag body with a tall shape as shown in FIG. 2 may tip over after installation and may lack stability. The bag body with a shape that is wide in the width direction as shown in FIG. 3 may be turned up after installation and may lack stability. Even if the dimension W in the width direction is the same, the same thing occurs depending on the length H1 of the restraining rope 14.

The inventors looked at the relationship between the dimensional ratio W/H1=(diameter/restraining rope length) and the diameter W, and conducted experiments to find, for each diameter, the dimensional ratio of the bag body 10 that may lack stability due to tipping over after installation and the width in the width direction of the bag body 10 that lacks stability due to turning up after installation.

That is, the behavior in waves of an object using a bag according to the present invention is a fluid phenomenon, and the similitude holds. Therefore, the state of each bag body (stable, turning up, tipping over) in waves in a two-dimensional wave channel was observed using 1/35 scale bag models of shapes with various diameters W and restraining rope lengths H1.

Specifically, bag body models filled with crushed stones within a certain particle size range and having a diameter W of 75 mm to 110 mm were placed in the wave channel and subjected to waves with a constant period (one second) from offshore to shore. For each diameter W, the manners in which the models with various restraining rope lengths H1 were moved (moved due to turning up, moved due to tipping over, etc.) as the wave height was gradually moved were observed, and the ratio of W/H1 at the wave height corresponding to the movement limit was obtained.

Figure 4:
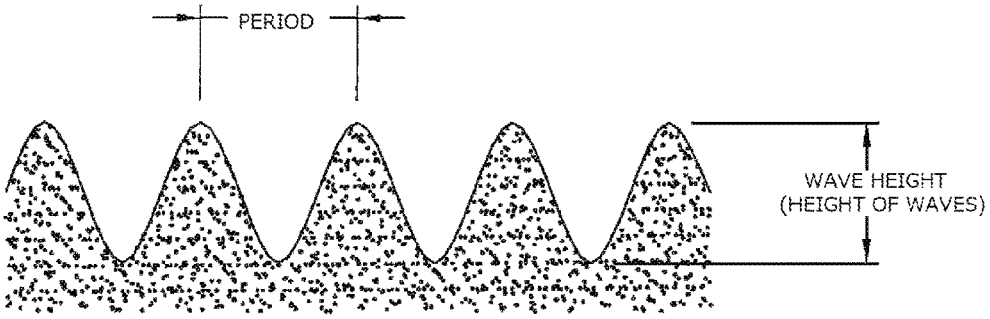
FIG. 4 is a diagram showing characteristics of waves.

Since the present embodiment is intended to examine the stability against waves in the sea, the stability was determined using the waves with a period of one second and the wave heights of 6 cm to 12 cm. FIG. 4 shows the characteristics of the waves, and FIG. 5 shows the structure of the wave channel used.

Figure 5:
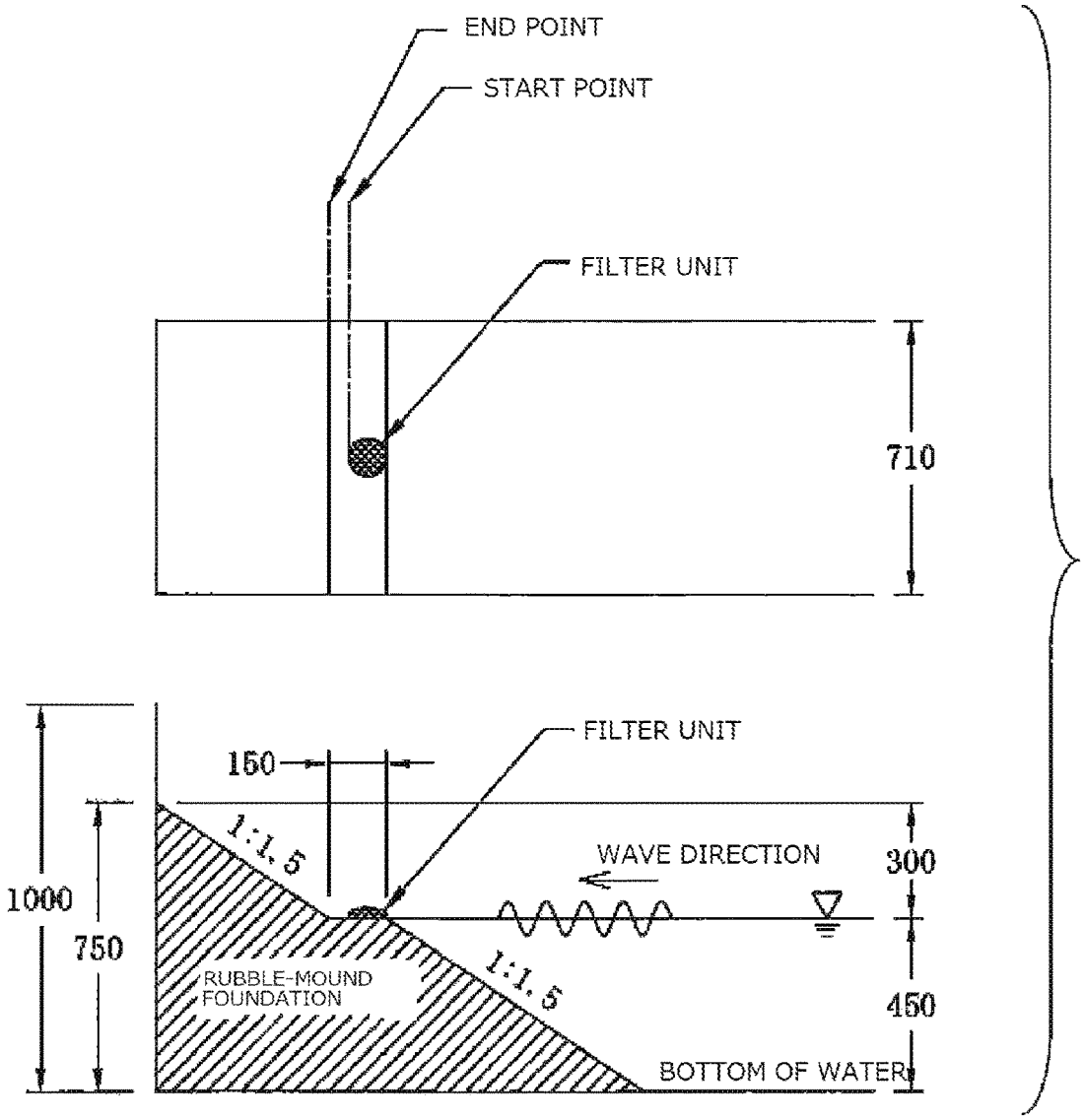
FIG. 5 is a diagram showing the configuration of a wave channel.

Referring to FIG. 5, the width, depth, and length of the wave channel are 710 mm, 1000 mm, and 30000 mm, respectively. A slope of 450 mm in the horizontal direction is provided so as to extend gradually downward from the left end toward the right at a ratio of 1:1.5, a horizontal step with a width of 150 mm is provided next to the slope, and then a slope of 675 mm in the horizontal direction is provided so as to extend gradually downward at the same ratio. This bank is formed by a rubble-mound foundation.

Each bag body filled with a filling material was placed on the right end of the step, and was subjected to waves from the right. The stability of the bag bodies filled with the filling material was thus determined.

The bag bodies filled with the filling material were subjected to the largest fluid force when placed near the shoreline. This is the most severe condition for evaluating the stability of the bag bodies.

When a bag body model is placed on the horizontal portion (150 mm) starting from the end of the downward sloping portion, there is a gap between the bag body model and the upward sloping portion because the bag body model diameter on the horizontal portion is smaller than 150 mm. The start and end of the movement in the gap were measured.

The start of the movement of the bag body model caused by the waves was defined as the "start point." When the bag body model came into contact with the upward sloping portion, it was determined to be the "end."

Table 1 shows the results. Table 1 shows H, H1, W/H1, W0, and W/W0 in the stable state for eight diameters W in the range of 75 mm to 110 mm.

TABLE 1

| Diameter: W (mm) | Height: H (mm) | Restraining Rope Length: H1 (mm) | W/H1 | Diameter of Most Stable Bag Material: W0 (mm) | W/W0 | Evaluation |
|---|---|---|---|---|---|---|
| 75.0 | 27.5 | 34.0 | 2.2 | 100.0 | 0.75 | ◎ |
| 80.0 | 26.0 | 30.5 | 2.6 | 100.0 | 0.80 | ◎ |
| 85.0 | 24.5 | 28.0 | 3.0 | 100.0 | 0.85 | ◎ |
| 90.0 | 23.5 | 26.0 | 3.5 | 100.0 | 0.90 | ◎ |
| 95.0 | 22.0 | 23.5 | 4.0 | 100.0 | 0.95 | ◎ |
| 100.0 | 20.5 | 21.0 | 4.8 | 100.0 | 1.00 | ◎ |
| 105.0 | 19.0 | 19.0 | 5.5 | 100.0 | 1.05 | ◎ |
| 110.0 | 18.0 | 17.5 | 6.3 | 100.0 | 1.10 | ◎ |
| 70.0 | 27.0 | 22.8 | 3.1 | 100.0 | 0.70 | ○ |
| 80.0 | 26.0 | 20.0 | 4.0 | 100.0 | 0.80 | ○ |
| 90.0 | 22.5 | 19.5 | 4.6 | 100.0 | 0.90 | ○ |
| 100.0 | 20.0 | 17.0 | 5.9 | 100.0 | 1.00 | ○ |
| 110.0 | 19.0 | 14.7 | 7.5 | 100.0 | 1.10 | ○ |
| 90.0 | 24.0 | 35.0 | 2.6 | 100.0 | 0.90 | ● |
| 100.0 | 22.0 | 29.0 | 3.4 | 100.0 | 1.00 | ● |
| 110.0 | 18.5 | 21.0 | 5.2 | 100.0 | 1.10 | ● |
| 80.0 | 29.0 | 70.0 | 1.1 | 100.0 | 0.80 | ×A |
| 90.0 | 25.0 | 55.0 | 1.6 | 100.0 | 0.90 | ×A |
| 100.0 | 21.5 | 35.0 | 2.9 | 100.0 | 1.00 | ×A |
| 110.0 | 19.0 | 30.0 | 3.7 | 100.0 | 1.10 | ×A |
| 75.0 | 29.0 | 18.5 | 4.1 | 100.0 | 0.75 | ×B |
| 80.0 | 28.0 | 13.5 | 5.9 | 100.0 | 0.80 | ×B |
| 90.0 | 26.5 | 15.0 | 6.0 | 100.0 | 0.90 | ×B |
| 100.0 | 23.5 | 13.5 | 7.4 | 100.0 | 1.00 | ×B |
| 110.0 | 21.0 | 13.5 | 8.2 | 100.0 | 1.10 | ×B |

"◎" indicates that the bag body model was stable even with a wave height of 10 cm or more.

"○" and "●" indicate that the bag body model was stable with a wave height of 8.5 cm or more and less than 10.0 cm.

"x" indicates that the bag body model was turned up, tipped over, or slid and was washed away with a wave height of less than 8.5 cm, in which "xA" indicates that the bag body model was unstable due to turning up, and "xB" indicates that the bag body model was unstable due to tipping over.

Referring to Table 1, most of the data marked with "◎" is H<H1, which seems different from FIG. 1. This is because space is created between the mesh and the filling material when the bag body is lifted. If there is no such space, the filling material is fixed in the bag body, and such a bag body does not conform to where it is placed. This is why there is such a case.

Figure 6:
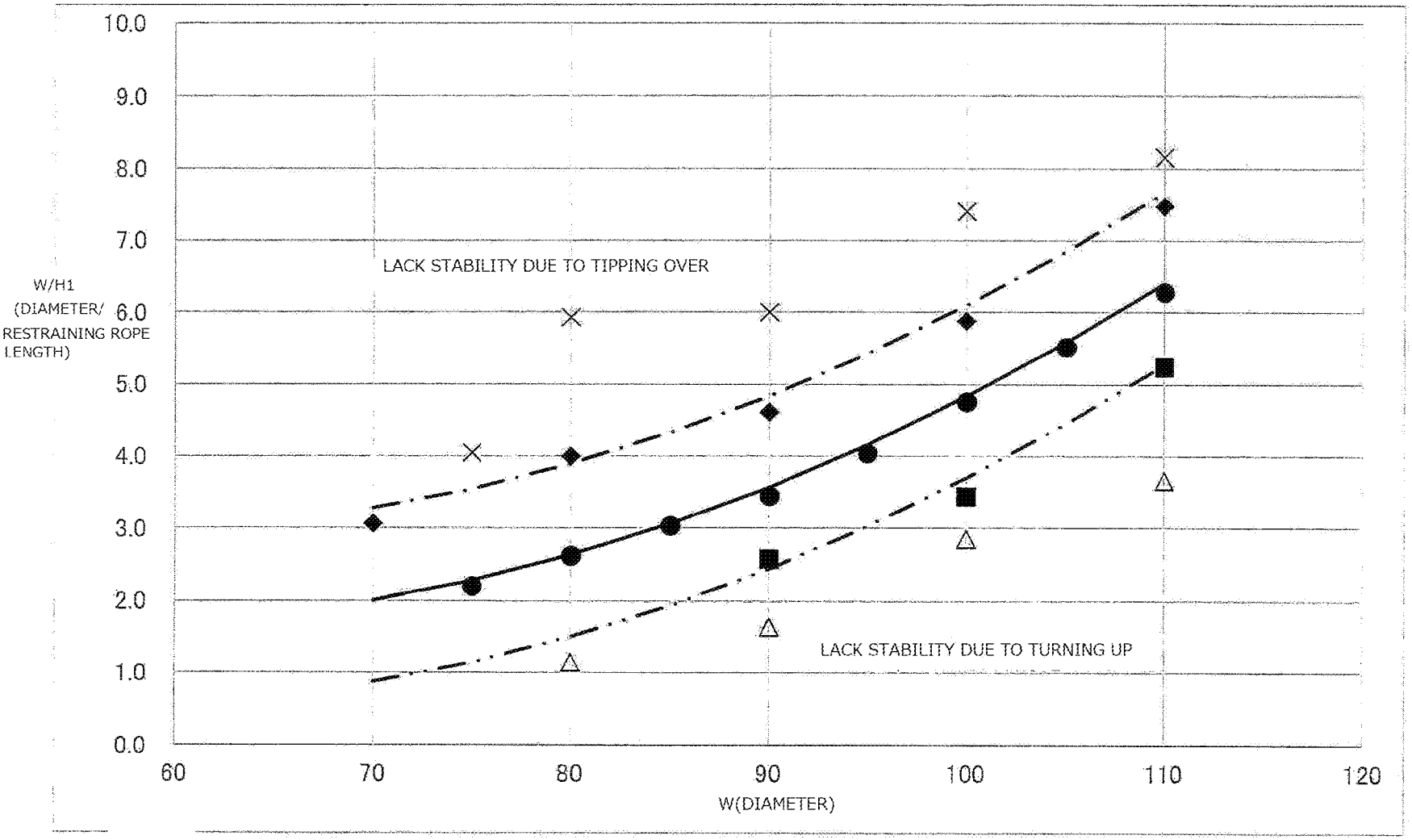
FIG. 6 is a graph showing the relationship between the diameter of the bag body and the diameter/restraining rope length based on experimental results.

FIG. 6 shows a graph of the data, where the abscissa represents the diameter W and the ordinate represents W/H1. It can be seen from FIG. 6 that, when the ratios of the diameter W to the restraining rope length H1 of the bag bodies 10 confirmed to be the most stable against waves are given by an approximation curve (curve connecting the points that represent the bag bodies marked with "◎" in Table 1 and that are shown by "●" in the graph), W/H1 (diameter/restraining rope length)=0.0016×W^2−0.178×W+6.33.

As used herein, "most stable" refers to the state in which the bag body is not moved due to turning up, tipping over, etc. between the "start point" and the "end."

The limit point to which stability against waves can be ensured is a wave height of 8.5 cm to less than 10.0 cm. It can also be seen from the figure that, when the ratios of the diameter W to the restraining rope length H1 of the bag bodies in this state are given by an approximation curve (curve connecting the points that represent the bag bodies marked with "○" in Table 1 and that are shown by "◆" in the graph), W/H1 (diameter/restraining rope length)=0.0016×W^2−0.178×W+5.5 (shown by a long dashed dotted line), and (curve connecting the points that represent the bag bodies marked with "●" in Table 1 and that are shown by "■" in the graph) W/H1 (diameter/restraining rope length)=0.0016×W^2−0.178×W+7.9 (shown by a long dashed double-dotted line).

According to the obtained curves, as W/H1 (diameter/restraining rope length) increases, the height of the bag body increases and the position of the center of gravity becomes higher, and therefore the bag body tips over, so that the bag significantly loses stability (long dashed dotted line).

As W/H1 (diameter/restraining rope length) decreases, the restraining property of the bag body is lost and the bag is turned up, so that the bag body significantly loses stability (long dashed double-dotted line).

The bag body shapes that fall within the range between the curves are the most effective against waves.

The actual bag bodies 10 are, for example, 4-ton, 6-ton, and 8-ton bag bodies 10 depending on their sizes, and these bag bodies have different in W, H1, etc. from each other. Therefore, nondimensionalizaion based on the results in Table 1 will be described. Nondimensionalization is performed by dividing the diameter of the shape of the bag body containing the restraining rope and filled with the filling material when the bag body is most stable against waves based on the experimental results by W0=100 mm.

Figure 7:
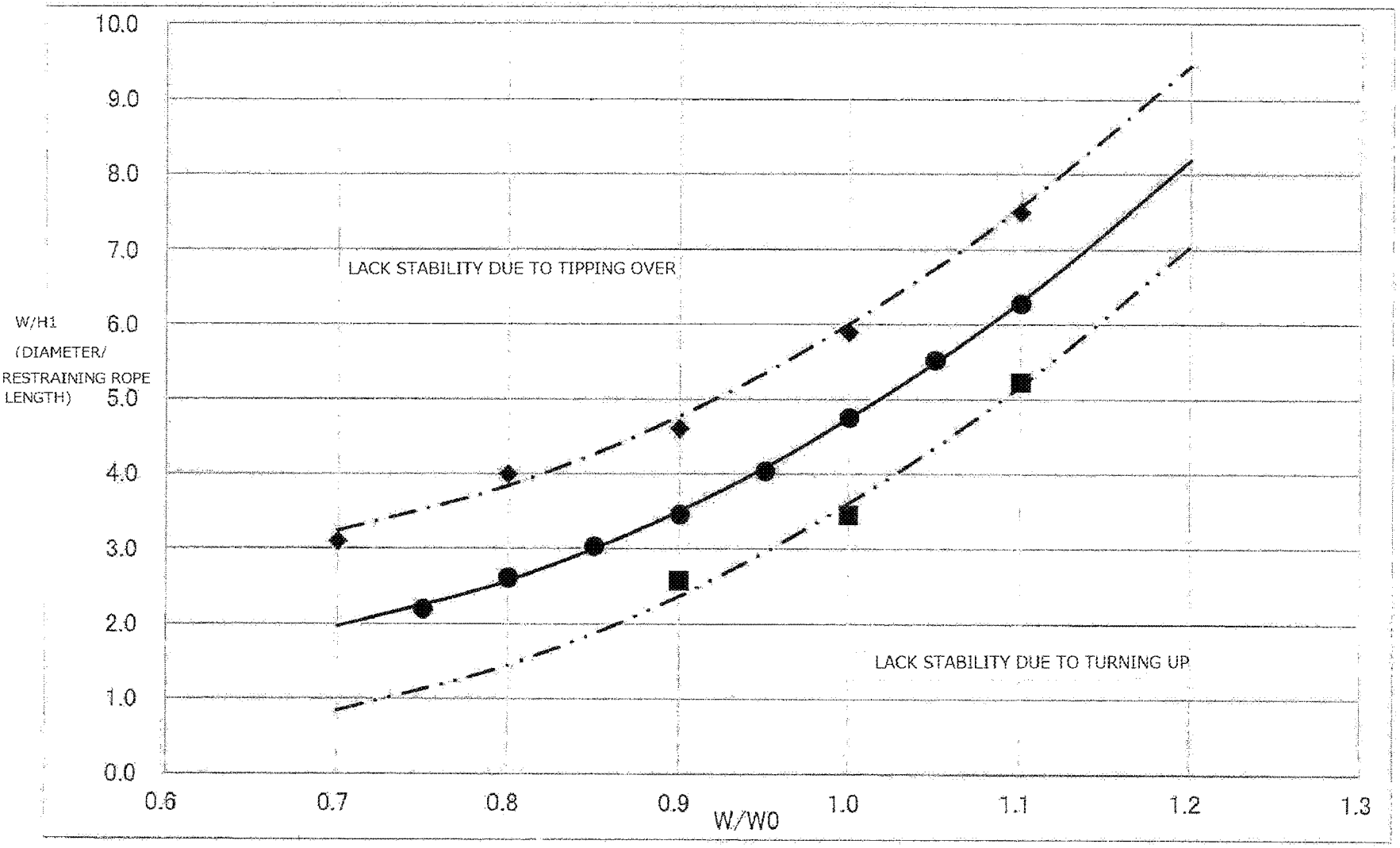
FIG. 7 is a graph showing the relationship between the diameter of the bag body and the diameter/restraining rope length when nondimensionalized based on the relationship in FIG. 6.

FIG. 7 shows the results. Referring to FIG. 7, the bag body characterized by W/H1 (diameter/restraining rope length)=15.898×(W/W0)^2−17.784×(W/W0)+6.6314 has the most stable shape against waves, where W represents the diameter of the bag 10 when the bag material is filled with stones, H1 represents the length of the restraining rope 14 from the bottom portion of the bag body 10 to the root position of a mouth closing rope 13 of the bag body through the center of the bag body 10, and W0 represents the diameter of the bag body 10 when the bag body 10 is the most stable against waves.

According to the obtained curves, as W/H1 (diameter/restraining rope length) increases, the height of the bag body increases and the position of the center of gravity becomes higher, and therefore the bag body may tip over, so that the bag significantly loses stability (long dashed dotted line).

As W/H1 (diameter/restraining rope length) decreases, the restraining performance of the bag body may be lost and the bag body may be turned up, so that the bag body significantly loses stability (long dashed double-dotted line).

The bag body shapes that fall within the range between the long dashed dotted line and the long dashed double-dotted line have stability against waves that is high enough to avoid movement due to turning up and tipping over. In order to quantify this range by the shapes for easier management during production of bag bodies, Table 2 was created using points having data on three or more values W.

TABLE 2

| W | W/H1 (Turned Up) | W/H1 (Stable) | W/H1 (Tipped Over) | Stable Range |
|---|---|---|---|---|
| 90 | 4.6 (1.31) | 3.5 (1.00) | 2.6 (0.74) | 0.74~1.31 |
| 100 | 5.9 (1.23) | 4.8 (1.00) | 3.4 (0.71) | 0.71~1.23 |
| 110 | 7.0 (1.11) | 6.3 (1.00) | 5.2 (0.82) | 0.83~1.11 |

Numerical values in parentheses indicate the ratios to the values calculated by the approximation curve W/H1 (diameter/restraining rope length)=15.898×(W/W0)^2−17.784×(W/W0)+6.6314.

It can be seen from the above results that the range in which the bag body is stable is the range characterized in that W/H1 is the minimum ratio of 83% to 111%, and that when limited to W<W0, the predetermined range is 71% to 119%.

The restraining rope contained in the bag body can restrain movement of the filling material. However, in order to further increase the stability, an optimal value of the restraining rope was obtained.

By obtaining H1=W/(15.898×(W/W0)^2−17.784×(W/W0)+6.6314) based on the above expression, it is possible to obtain the length of the restraining rope of the bag material at an optimal fixing position after filling with the filling material according to the value of W. It is thus possible to provide a method for manufacturing a bag body having such a configuration.

Figure 8:
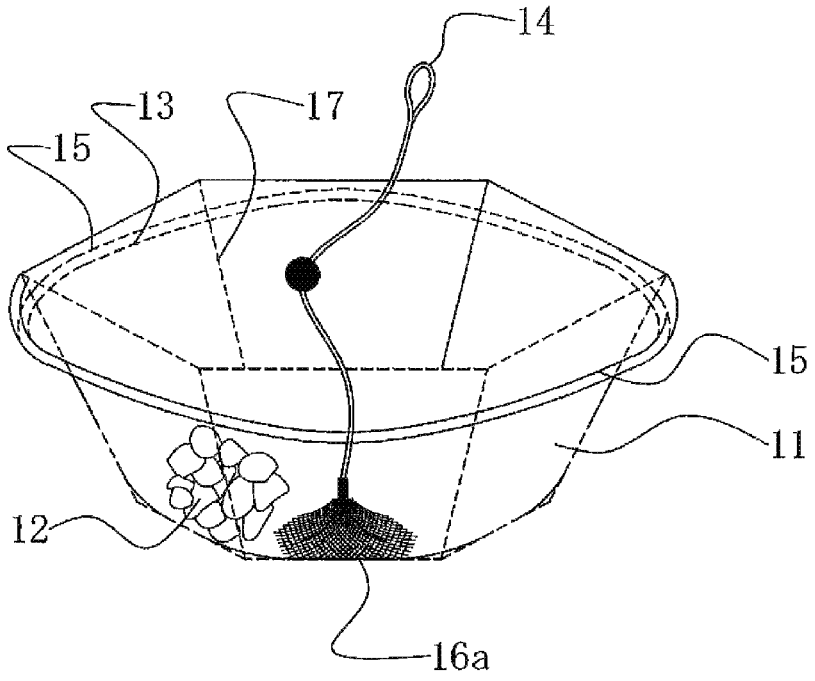
FIG. 8 is a diagram showing a method for manufacturing a bag body.

FIG. 8 is a diagram showing a method for manufacturing a bag, body clearly indicating the length of the restraining rope at the optimum fixing position after filling with the filling material. Referring to FIG. 8, in manufacturing of the bag body according to the present embodiment, the bag material 11 is placed into a bag production frame 17 having the shape of an inverted truncated hexagonal pyramid in such a manner that the lifting rope 15 around the opening of the bag material 11 is caught by the opening end of the production frame 17. At this time, the mouth closing rope 13 is inserted through the mesh under the lifting rope 15 extending around the opening of the bag material 11, one end of the restraining rope 14 is fixed to the bottom portion **16*a* of the bag material 11, and the other end thereof is pulled out of the bag material 11 so as to pass through the center of the bag material 11. In this state, the filling material 12 such as stones is placed into the bag material 11**.

H1 of the restraining rope 14 from the base portion **16*a* is obtained based on the above expression, and an optimal fixing position of the restraining rope may be marked in advance at the restraining rope position of the obtained length (shown by D in FIG. 8**). This marking allows to know at which position the rope should be tied when manufacturing the bag body.

Thereafter, the opening of the bag material is closed with the lifting rope 15, and the portion around the closed opening is tied with the mouth closing rope 13.

The bag body is thus completed, and the bag body is removed from the production frame 17 by pulling up the restraining rope 14 and the lifting rope 15 together.

The restraining rope 14 is preferably a rope or belt made of synthetic fibers.

Calculation examples of the length H1 of the restraining rope are shown for reference. Of the bag bodies marked with "◎," the bag body with W=75 mm (actual size 2625 mm) has a restraining rope length H1 of 1190 mm, the bag body with W=90 mm (actual size 3150 mm) has a restraining rope length H1 of 910 mm, and the bag body with W=110 mm (actual size 3850 mm) has a restraining rope length H1 of 612 mm.

The above embodiment illustrates the case where one restraining rope is attached to the bottom portion of the bag material. However, the present invention is not limited to this, and the restraining rope may include mesh at the bottom portion of the bag material bundled and pulled up toward the mouth portion.

The above embodiment illustrates the case where the optimal fixing position of the restraining rope is marked in advance at one restraining rope position. However, the present invention is not limited to this, and the restraining rope may be a combination of a collection of mesh at the bottom portion of the bag material bundled and pulled up toward the mouth portion and a rope connected to the collection, and the optimal fixing position of the restraining rope may be marked on the combination.

Although the embodiment of the present invention is described above with reference to the drawings, the present invention is not limited to the illustrated embodiment. Various modifications and variations can be made to the illustrated embodiment within the scope that is the same as or equivalent to that of the invention.

INDUSTRIAL APPLICABILITY

The bag body according to the present invention has the highest stability against waves, and is therefore advantageously used as a bag that is stable against waves.

REFERENCE SIGNS LIST

10: Bag Body, 11: Bag Material, 12: Filling Material, 13: Mouth Closing Rope, 14: Restraining Rope, 15: Lifting Rope, **16*a*: Bottom Portion, 16*b***: Upper End of Bag Body

The invention claimed is:

1. A bag body comprising a bag material including a bottom portion and an opening portion, wherein a lifting rope is provided around the opening portion, a restraining rope that is pulled out through the opening portion is provided at the bottom portion, the bag material is filled with a filling material to form the bag body, the opening portion is closed after the bag material is filled with the filling material, and the bag body is within a predetermined range centered about a curve given by W/H1 (diameter/restraining rope length)=15.898×(W/W0)^2−17.784×(W/W0)+6.6314, where W represents a diameter of the bag body, H1 represents a length of the restraining rope from the bottom portion of the bag body to a root position of a mouth closing rope of the bag material through a center of the bag body, and W0 represents a diameter of the bag body when the bag body formed by filling the bag material with the filling material is most stable against waves.

2. The bag body according to claim 1, wherein:

the predetermined range is a range of 83% to 119%.

3. The bag body according to claim 1, wherein:

the restraining rope is a rope or belt made of synthetic fibers.

4. The bag body according to claim 1, wherein:

the restraining rope includes mesh at the bottom portion of the bag material bundled and pulled up toward the opening portion.

5. The bag body according to claim 4, wherein:

the mouth closing rope is provided around the opening portion below the lifting rope, the opening portion is closed by the mouth closing rope, and the restraining rope is combined with the lifting rope and the mouth closing rope.

6. The bag body according to claim 4, wherein:

the restraining rope is a combination of a collection of mesh at the bottom portion of the bag material bundled and pulled up toward the opening portion and a rope connected to the collection, and an optimal fixing position of the restraining rope is marked on the restraining rope.

7. A method for manufacturing a bag body according to claim 6, wherein the method comprising steps of:

preparing a production frame for the bag body; and preparing the lifting rope around an opening, the mouth closing rope provided under the lifting rope, and the bag material including the restraining rope having one end fixed to the bottom portion of the bag material, wherein an optimal fixing position of the restraining rope in the bag body is marked on the restraining rope, the method further comprising the steps of:

placing the bag material into the production frame in such a manner that the lifting rope around the opening of the bag material is caught by an opening end of the production frame, and pulling an opposite end of the restraining rope out of the bag material so as to pass through the center of the bag material, and in this state, placing the filling material into the bag material until the filling material reaches the optimal fixing position of the restraining rope for the bag material; and after placing the filling material, closing the opening of the bag material with the mouth closing rope, and removing the bag body from the production frame using the restraining rope and the lifting rope.

* * * * *